US007883072B2

(12) United States Patent
Kondo et al.

(10) Patent No.: US 7,883,072 B2
(45) Date of Patent: Feb. 8, 2011

(54) SHAKING APPARATUS, SHAKING METHOD, AND AUDIOVISUAL SYSTEM

(75) Inventors: Tetsujiro Kondo, Tokyo (JP); Haruo Oba, Kanagawa (JP); Kenichiro Ueno, Kanagawa (JP); Takafumi Yamaki, Tokyo (JP); Tetsushi Kokubo, Kanagawa (JP)

(73) Assignee: Sony Corporation, Tokyo (JP)

( * ) Notice: Subject to any disclaimer, the term of this patent is extended or adjusted under 35 U.S.C. 154(b) by 1022 days.

(21) Appl. No.: 11/517,643

(22) Filed: Sep. 8, 2006

(65) Prior Publication Data

US 2007/0075576 A1 Apr. 5, 2007

(30) Foreign Application Priority Data

Sep. 9, 2005 (JP) ..... 2005-261781

(51) Int. Cl.
*A47C 3/00* (2006.01)

(52) U.S. Cl. ..... 248/653; 248/637; 297/217.1; 297/217.4

(58) Field of Classification Search ..... 248/559, 248/646, 651–654; 297/217.1, 217.3, 217.4
See application file for complete search history.

(56) References Cited

U.S. PATENT DOCUMENTS 3,628,829 A * 12/1971 Heilig ..... 297/217.4
5,348,370 A * 9/1994 Fukuoka ..... 297/217.3
5,678,889 A * 10/1997 Purcell, Jr. ..... 297/257
6,056,362 A * 5/2000 de la Haye ..... 297/314
6,702,767 B1 * 3/2004 Douglas et al. ..... 601/15
6,733,293 B2 * 5/2004 Baker et al. ..... 434/55
2004/0023718 A1 2/2004 Kondo et al.

FOREIGN PATENT DOCUMENTS

JP 7 54418 6/1995
WO WO 00 68886 11/2000

* cited by examiner

*Primary Examiner*—Terrell Mckinnon
*Assistant Examiner*—Steven M Marsh
(74) *Attorney, Agent, or Firm*—Frommer Lawrence & Haug LLP; William S. Frommer; Thomas F. Presson

(57) ABSTRACT

A shaking apparatus for shaking a seat where a user sits down, including actuators, wherein the seat is supported by supporting parts at least at a front side, a rear left side and a right side, or a rear side, a front left side and a right side. The seat is inclined left or right by complementarily operating the actuators mounted to the left and right supporting parts to complementarily vary the distance from a floor of the left and right supporting parts, and the seat is inclined forward or backward by equally operating the actuators mounted to the left and right supporting parts to equally vary the distance of the left and right supporting parts from the floor.

8 Claims, 10 Drawing Sheets

SHAKING APPARATUS, SHAKING METHOD, AND AUDIOVISUAL SYSTEM

CROSS REFERENCES TO RELATED APPLICATION

The present invention contains subject matter related to Japanese Patent Application JP 2005-261781 filed in the Japanese Patent Office on Sep. 9, 2005, the entire contents of which being incorporated herein by reference.

BACKGROUND OF THE INVENTION

1. Field of the Invention

The present invention relates to a shaking apparatus, a shaking method, and an audiovisual system, which is capable of providing reality to viewers, as if they exist in the scenes of pictures displayed in front of them, by shaking the seat synchronously with the pictures, for example. According to an embodiment of the invention, a seat for a user is supported by three supporting parts at a front side, a rear left side and a right side or at a rear side, a front left side and a right side, and is inclined forward or backward and left or right by operating actuators mounted to the two supporting parts so as to vary the distance of the left and right supporting parts from the floor. Accordingly, the shaking apparatus can be manufactured with a simple structure and small size as compared with the related art.

2. Description of the Related Art

In the related art amusement facilities or public facilities, viewers are provided with reality, as if they are in a vehicle by displaying pictures taken from the vehicle on a big screen and synchronously shaking their seats with the pictures displayed on the screen using shaking apparatus.

As for audiovisual systems, a method of shaking seats according to the estimated results after estimating the motions of a vehicle from pictures displayed on a screen is disclosed, for example, in WO00/68886.

A configuration of a shaking apparatus applied to such audiovisual systems is disclosed in JP-A-62-262887. The shaking apparatus inclines the seat forward or backward and left or right and shakes the seat while the user is seated.

If such an audiovisual system is configured using a general domestic AV system, the entertainment obtained from the AV system can be improved. However, known shaking apparatuses are designed to be used for amusement facilities or public facilities, such that their structures are complicated and large in size. Therefore, known shaking apparatuses are not suitable for general domestic use in practice. Accordingly, a small-sized shaking apparatus having a simple structure may meet a need in domestic use.

SUMMARY OF THE INVENTION

It is desirable to provide a shaking apparatus, a method of shaking, and a small sized audiovisual system having a relatively simple structure in respect to the related art.

According to an embodiment of the invention, there is provided an shaking apparatus that shakes a seat where a user sits down, including actuators, in which the seat is supported by supporting parts at least at a front side, a rear left side and a right side, or a rear side, a front left side and a right side, and is inclined left or right by complementarily operating the actuators mounted to the left and right supporting parts to complementarily vary the distance of the left and right supporting parts from the floor. In addition, the seat is inclined forward or backward by equally operating the actuators mounted to the left and right supporting parts to equally vary the distance of the left and right supporting parts from the floor.

According to another embodiment of the invention, there is provided a method of shaking a seat where a user sits down, including the steps of: supporting the seat by supporting parts at least at a front side, a rear left side and a right side, or a rear side, a front left side and a right side; inclining the seat left or right by complementarily operating actuators mounted to the left and right supporting parts to complementarily vary the distance of the left and right supporting parts from the floor; and inclining the seat forward or backward by equally operating the actuators mounted to the left and right supporting parts to equally vary the distance of the left and right supporting parts from the floor.

According to another embodiment of the invention, there is provided an audiovisual system including a shaking apparatus that shakes a seat where a user sits down, including actuators, in which the seat is supported by supporting parts at least at a front side, a rear left side and a right side, or a rear side, a front left side and a right side, and is inclined left or right by complementarily operating the actuators mounted to the left and right supporting parts to complementarily vary the distance of the left and right supporting parts from the floor. In addition, the seat is inclined forward or backward by equally operating the actuators mounted to the left and right supporting parts to equally vary the distance of the left and right supporting parts from the floor.

According to the embodiment as described above, the seat is supported by supporting parts at least at the front, rear left, and right sides, or the rear, front left, and right sides, is inclined left or right by complementarily operating actuators mounted to the left and right supporting parts to complementarily vary the distance of the left and right supporting parts from the floor, and is inclined forward or backward by equally operating the actuators mounted to the left and right supporting parts to equally vary the distance of the left and right supporting parts from the floor. Accordingly, the seat can be inclined forward or backward and left or right by operating two actuators, thus the shaking apparatus can be manufactured with a simple structure and small size.

According to another embodiment of the invention, a shaking method simply configured as compared with the related art can be provided.

According to another embodiment of the invention an audiovisual system using a small-sized shaking apparatus having a simple structure as compared with the related art can be provided.

According to the embodiments of the invention, a small and simple structure can be achieved.

BRIEF DESCRIPTION OF THE DRAWINGS

FIGS. 1A, 1B, 1A1 and 1B1 show side views and rear views of a chair of a shaking apparatus according to first embodiment of the invention;

FIGS. 5A, 5B, 5A1 and 5B1 are side views illustrating legs for the chair of FIGS. 1A, 1B, 1A1 and 1B1;

DESCRIPTION OF THE PREFERRED EMBODIMENTS

Preferred embodiments of the invention are described hereafter with reference to accompanying drawings.

First Embodiment (1) Configuration of Embodiment

Figure 2:
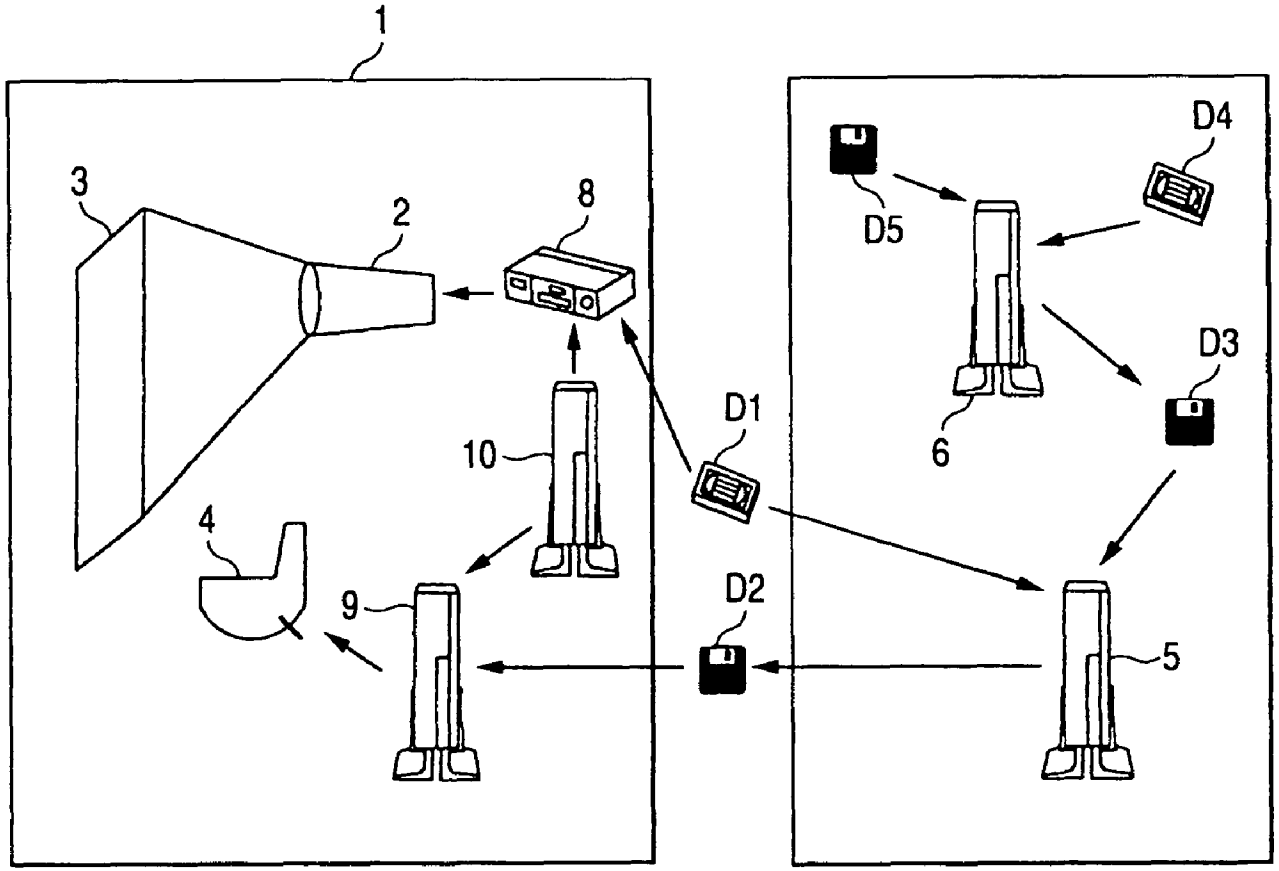
FIG. 2 is a view schematically illustrating an audiovisual system according to a first embodiment of the invention.

FIG. 2 is a view illustrating the configuration of an audiovisual system according to an embodiment of the invention. An audiovisual system 1 displays pictures using a projector 2 and a screen 3 and also outputs a sound corresponding to the pictures through speakers (not shown), which constitute an AV system. The audiovisual system 1 provides reality to a user, as if the user is in the scenes of pictures in reality through sounds and pictures by shaking of a shaking apparatus, i.e. a chair 4 that operates depending on the pictures displayed on the screen 3.

Therefore, in the audiovisual system 1, AV data D1 of sounds and pictures and shaking data D2 controlling the operation of the shaking apparatus are provided by a recording medium or through a network such as the internet.

The AV data D1 is obtained by editing video data and audio data obtained by capturing the front area of a vehicle by using a video camera mounted on the vehicle. The shaking data D2 corresponding to the AV data D1 is obtained by processing video data about the AV data 1 using a shaking data forming device 5.

The shaking data forming device 5 is a computer and detects the motion of video data of the AV data D1 and generates shaking data D2 corresponding to the motion on the basis of a predetermined image shaking data coefficient D3. Accordingly, the shaking data forming device 5 detects the motion of video data of AV data D1, estimates the motion at the side where an object is taken based on the motion, and forms shaking data D2 to recreate the motion where an object is taken. The image shaking data coefficient D3 is formed by comparing the motion of video data D4 obtained by capturing the front area of a vehicle by using a video camera mounted on a vehicle with shaking data D5, detected results obtained from an acceleration sensor mounted on the vehicle using the computer 6.

The audiovisual system 1 plays the AV data D1 using a playback device 8, such as a video tape recorder or DVD player, etc., and provides it to a user. A shaking controller 9 shakes the chairs 4 on the basis of the shaking data D2 and a synchronization controller 10 synchronizes the operations of the playback device 8 and the shaking controller 9 by. controlling them on the basis of time codes.

Figure 1A:
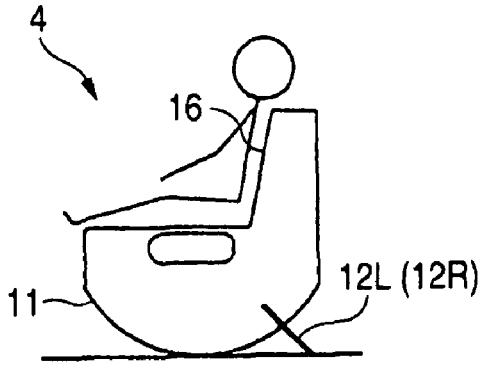
Figure 1B:
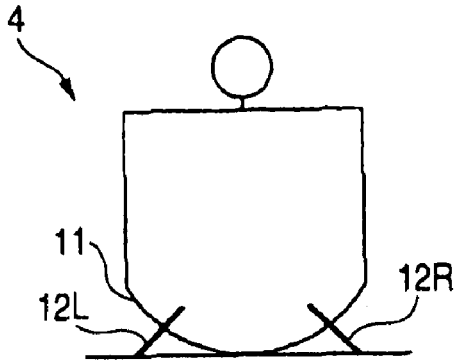
Figure 1B:
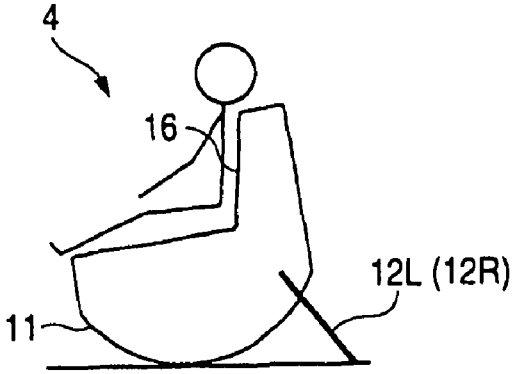
Figure 1B:
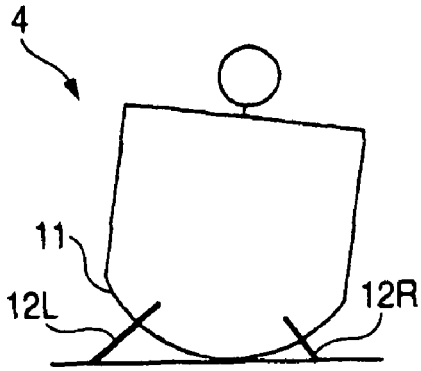

FIGS. 1A and 1B are a side view and a rear view of the chair 4, respectively. In the chair 4, a seat 16 where a user sits down is a shaking apparatus that is driven and shaken by the shaking controller 9, and three supporting parts support the seat 16 at the front, rear left, and right sides.

In other words, the bottom 11 of the chair 4 is curved like a hemisphere and legs 12L and 12R are provided at the rear left and right sides of the bottom 11. The bottom 11 may be part of an ellipsoidal sphere instead of the hemisphere. The legs 12L and 12R are rod-shaped parts extending from the rear left and right sides of the bottom 11 and of which the ends contact the floor whenever a user is seated or not seated.

Therefore, the chair 4 is supported by three supporting parts, the hemispherical bottom and the ends of the legs 12L and 12R that contact with the floor. The three supporting parts are the apexes of an isosceles triangle in plan view, and the side intervening the two corners of the identical angle of the isosceles triangle is disposed on the side of the rear of the chair 4.

Accordingly, as shown in FIG. 1A1, the seat 16 of the chair 4 can be inclined forward or backward by equally retracting the legs 12L and 12R at the rear left and right sides to equally vary the distance of the right and left supporting parts of the legs 12L and 12R from the floor. The seat 16 can also be inclined left and right, as shown in FIG. 1B1, by complementarily retracting the legs 12L and 12R at the rear left and right sides to complimentarily vary the distance of the right and left supporting parts of the legs 12L and 12R from the floor.

Figure 3:
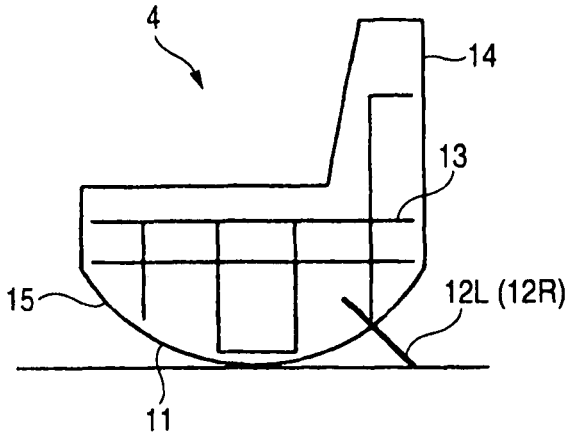
FIG. 3 is a side view illustrating the structure of a frame of the chair of FIGS. 1A, 1B, 1A1 and 1B1.

As shown in FIG. 3, the internal framework 13 of the chair 4 is formed by assembling metal plates of an aluminum alloy, etc. A frame 15 is formed by disposing a shell 14, such as a reinforced plastic, to the internal framework 14. The bottom 11 and the back of the chair 4, etc. are defined by the frame 15.

The internal framework 13 has functions which can support a load of the entire device and prevent deformation of the shell 14. In order to achieve the functions, the internal framework 13 should be sufficiently reinforced. On the other hand, non-skid treatment is applied to at least a region of the shell 14 that may have contact with the floor, which prevents movement caused by the shaking. The non-skid treatment is applied by adhering, for example, a rubber seat on the surface of the region.

Figure 4A:
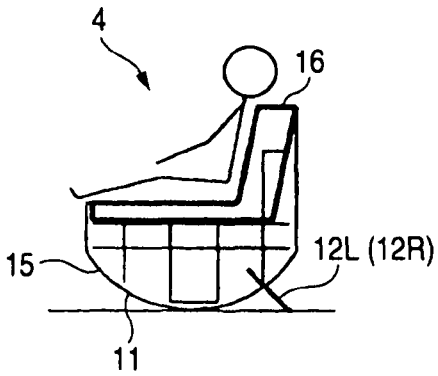
FIGS. 4A and 4B are side views illustrating arrangement of a seat in the chair of FIGS. 1A, 1B, 1A1 and 1B1.
Figure 4B:
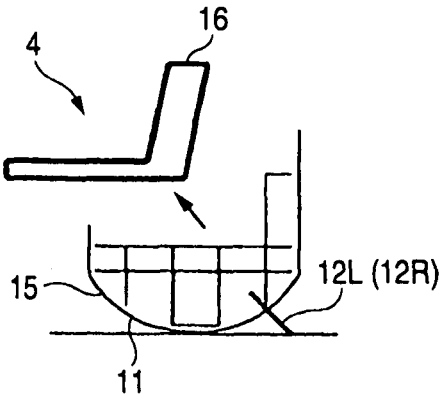

As shown in FIG. 4A, the seat 16 is disposed where a user sits down on the frame 15 of the chair 4. As shown in FIG. 4B, the seat 16 may be detachably mounted on the frame 15, if needed, such that it can be simply replaced with another seat in respect to the interest or taste of a user and a variety of components mounted to the frame 15 can be simply maintained.

Figure 5A:
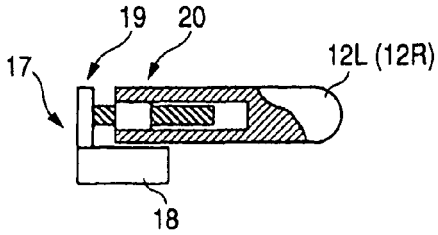
Figure 5B:
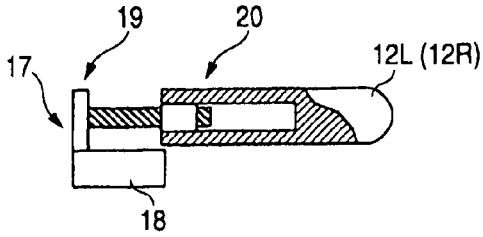
Figure 5B:
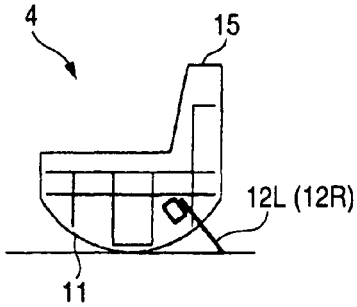
Figure 5B:
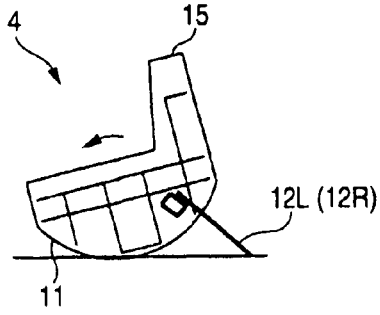

FIGS. 5A, 5B, 5A1 and 5B1 are side views showing a part of the cross-section of the legs 12L and 12R retracted and extended, respectively. The legs 12L and 12R are fixed to the frame 15 such that they are extended or retracted by actuators 17. According to this embodiment, the actuator 17 includes a servo motor 18, a gear 19 reducing the rotational speed of the servo motor 18, and a screw mechanism 20 rotated by the rotational force of the gear 19 so as to extend or retract in the extension direction the leg 12L or 12R.

As shown in FIG. 5B1 for comparing with FIG. 5A1, as the legs 12L and 12R are equally extended by the actuators 17, the chair 4 is inclined forward.

The ends of the legs 12L and 12R are formed of a hemispherical smooth material so that the parts contacting the floor can smoothly slide, when extending or retracting.

Figure 6B:
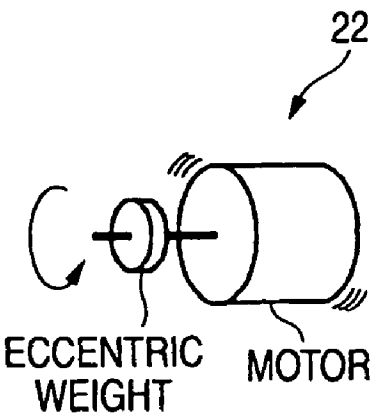
FIGS. 6A and 6B are views illustrating a vibrator for the chair of FIGS. 1A, 1B, 1A1 and 1B1.
Figure 6A:
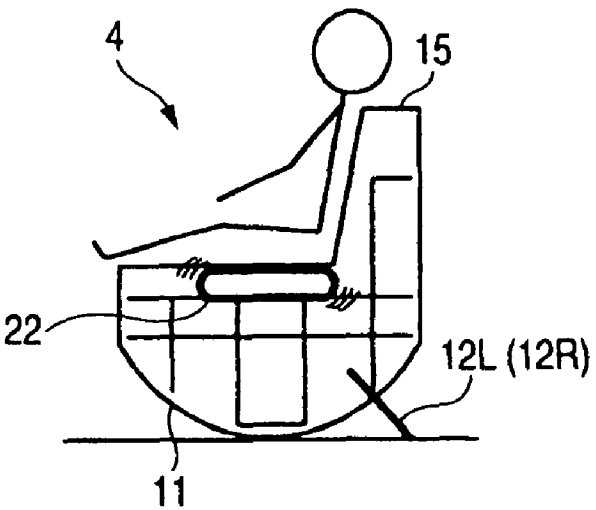

AS shown in FIG. 6A, a vibrator 22 is provided to the chair 4, which is mounted, for example, under the seat 16 to transmit the shake vibrated by an external driving force to a user seated on the seat 16. As shown in FIG. 6B, according to this embodiment, the vibrator 22 includes an eccentric weight and a motor rotating the eccentric weight.

Figure 7:
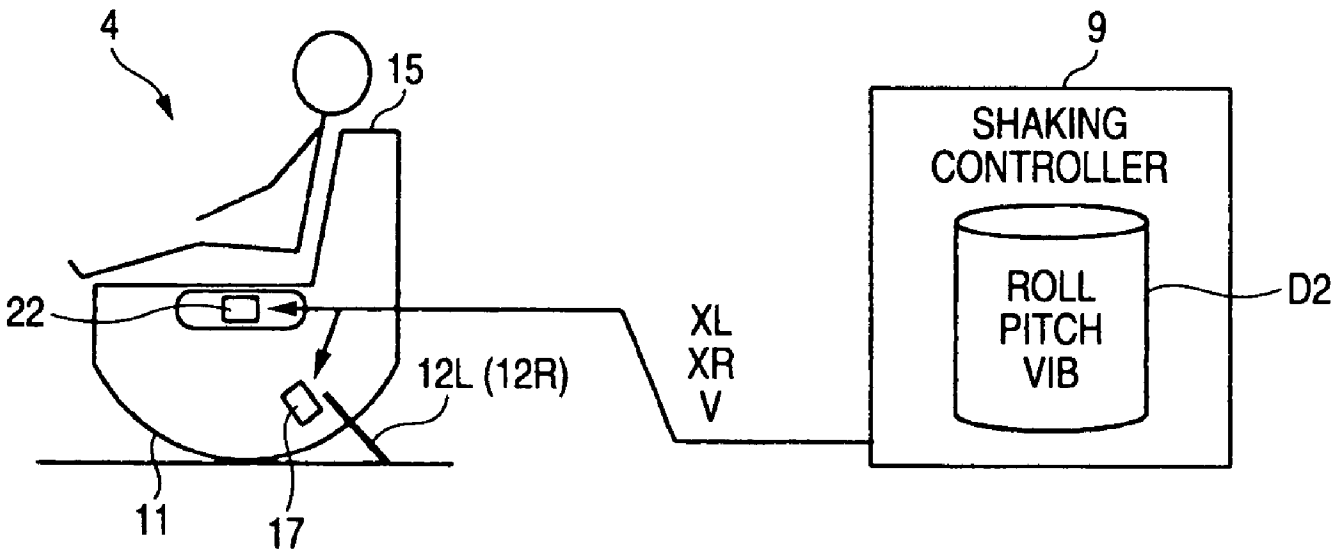
FIG. 7 is a diagram schematically illustrating the driving of the chair of FIGS. 1A, 1B, 1A1 and 1B1.

AS shown in FIG. 7, in the audiovisual system 1, the shaking controller 9 operates actuators 17 corresponding to the legs 12L and 12R according to shaking data D2 on the basis of time codes. The chair 4 is inclined forward or backward and left or right by the actuator's operation, which transmits the acceleration of a vehicle in a picture to a user so as to sense acceleration. Similarly, the vibrator 22 is operated according to the shaking data D2, which allows the user to sense the impact, etc. of the vehicle in the picture.

In the operation of the vibrator 22 the rotational speed of the motor is controlled to control the strength of the vibration. When strong vibration needs to be transmitted to a user, the rotational speed of the motor is increased.

Figure 8B:
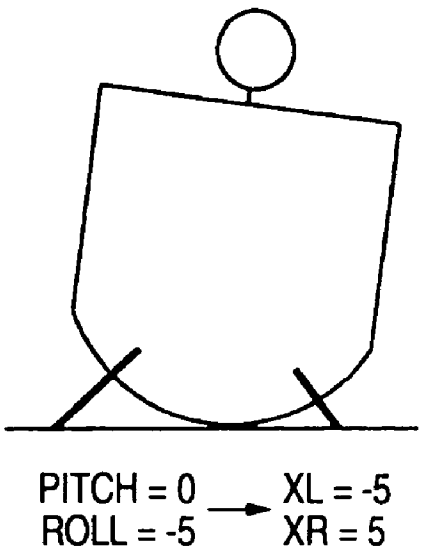
FIGS. 8A and 8B are diagrams schematically illustrating the inclination forward or backward and left or right.
Figure 8A:
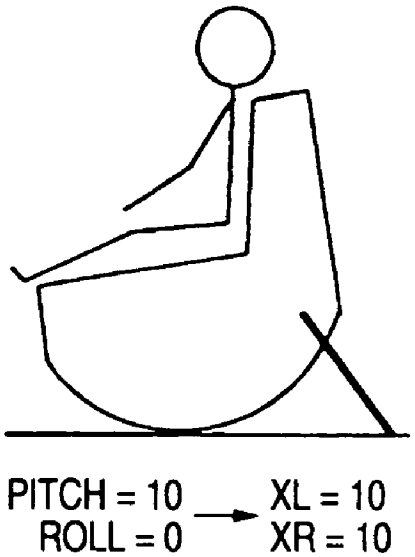
Figure 8A:
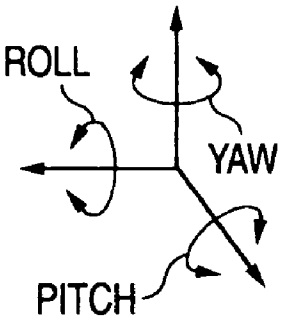

Meanwhile, the amount of extension or retraction of legs 12L and 12R is estimated, as shown in FIGS. 8A and 8B, with respect to the inclining directions of the chair 4 due to the roll, yaw, and pitch, and then the actuator 17 operates according to the estimated result.

A position where the legs 12L and 12R support the seat 16 in parallel with the floor is defined as a normal position. When the variations in the distance of the legs 12L and 12R from the normal position are xL and xR, the forward or backward (the pitch direction) and left or right (the roll direction) inclined amounts of the seat are pP and pR, the variations xL and xR are respectively expressed by XL=(pP+pR) and xR=(pP−pR). However, the above expressions are just very simple examples and, in practice, the shaking controller 9, for example, searches a table, which defines the inclined amounts in each direction and the driving amounts of the actuators 17 required to secure the inclined amounts, from the shaking data D2 and detects the driving amounts of the actuators 17, and then operates the actuators 17 as much as the detected driving amounts.

(2) Operation of Embodiment

According to the configuration as described above, in the audiovisual system 1 (FIG. 2), video data D4 is obtained in advance by capturing front areas from a variety of vehicles and shaking data D5 is obtained by detecting the acceleration of the vehicles in each direction, and then image shaking data coefficients D3, which are obtained from the video data D4 and the shaking data D5 to represent a relationship between the motion of the vehicles detected from the picture obtained by capturing the front areas and the acceleration in each direction of the vehicles are recorded in the shaking data forming device 5. Further, the shaking data forming device 5 analyzes the picture from the video data D1 obtained by capturing the front area of the vehicle and shaking data D2 is generated on the basis of the image shaking data coefficient D3 according to the analyzed result.

In the audiovisual system 1, the picture obtained from the video data D1 including the shaking data D2 is projected to the screen 3 and the chair 4 shakes forward or backward and left or right by the shaking data D2 according to the picture projected to the screen 3. AS the chair 4 shakes, a user receives a variety of contents through pictures and sounds, that is, can receive a variety of contents in reality, as if he/she exists in the scene of the contents.

In the chair 4 shaken according to the shaking data D2, the seat 16 where a user sits down is supported by the three supporting parts at the front, rear left, and right sides (FIGS. 1A, 1B, 1A1 and 1B1) and inclined forward or backward and left or right by varying the distance from the floor at the left and right parts of the three parts by operating the actuators 17 mounted at the left and right parts.

In more detail, the seat 16 is inclined forward or backward, when the two actuators 17 equally operate, and left and right, when the actuators 17 complementarily operate. Accordingly, the seat 16 is capable of shaking in a variety of directions by the operation of the actuators 17. According to the embodiment configured as above, because the shaking apparatus can be operated by just the two actuators 17, it can be simply structured. As a result, a small-sized shaking apparatus can be obtained. Therefore, flexibility in the design considerably increases, and a design for general domestic furniture can be achieved without a sense of incongruity.

In the chair 4, the bottom of the seat 16 facing the floor is curved such as a hemisphere or an ellipse (FIG. 3) to incline the seat 16 in a variety of directions by operating the left and right actuators 17, and the part contacting the floor is the other supporting part other than the above-mentioned two parts. In the chair 4 configured as above, the seat 16 can be inclined in a variety of directions smoothly with a small operating force by varying the distance of the left and right supporting parts from the floor to incline the seat 16 using the actuators 17. This makes it possible to simplify and miniaturize the structure of the shaking apparatus.

In addition, the vibrator 22 is mounted under the seat 16 of the chair 4, and as for the audiovisual system 1, the seat 16 is shaken by operating the vibrator 22 and impacts, etc. of a vehicle are transmitted to a user. Therefore, according to the chair 4, a user can be provided with a more reality view.

(3) Effects of Embodiment

According to the above configuration, the seat where a user sits down is supported by the three supporting parts at the front, rear left, and right sides and inclined forward or backward and left or right by varying the distance of the left and right supporting parts from the floor by operating the actuators mounted to the two parts. Accordingly, the chair can be simply structured in small size, as compared with the related art.

The left and right supporting parts are legs contacting the floor and the legs are extended or retracted by operating the actuator, so that the seat can be easily inclined forward or backward and left or right.

The bottom of the seat facing the floor is curved and a part of the bottom is the front supporting part, so that the seat can be smoothly shaken with a small driving force.

Due to the bottom being formed in a specific shape, such as a hemisphere or an ellipse, the seat can be smoothly shaken with a small driving force.

Because the distance of the left and right supporting parts from the floor can be varied by operating the actuators, the seat can be shaken forward or backward and left or right in a simple structure.

The vibrator is provided to vibrate the seat, so that reality can be improved

Second Embodiment

Figure 9:
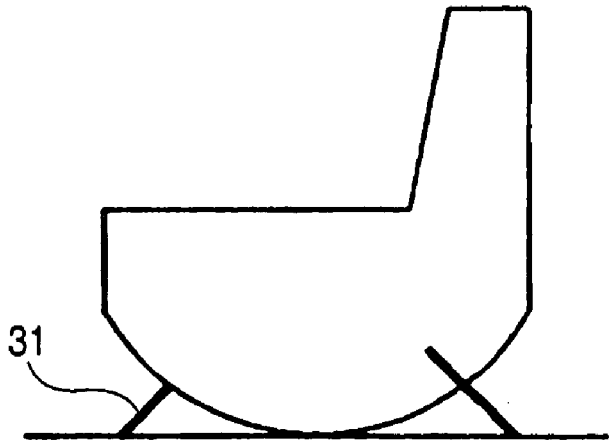
FIG. 9 is a side view of a shaking apparatus according to a second embodiment of the invention.
Figure 10:
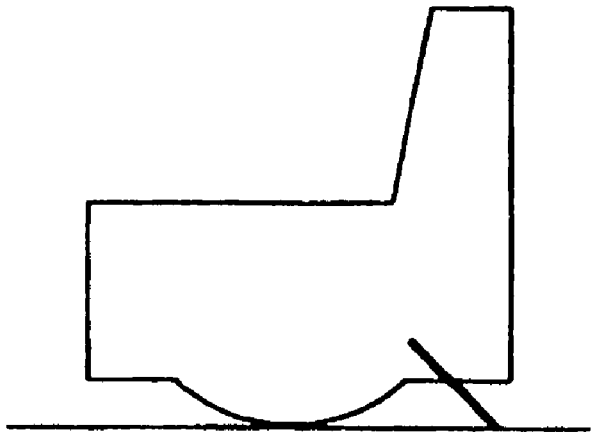
FIG. 10 is a side view of a shaking apparatus according to a third embodiment of the invention.
Figure 11:
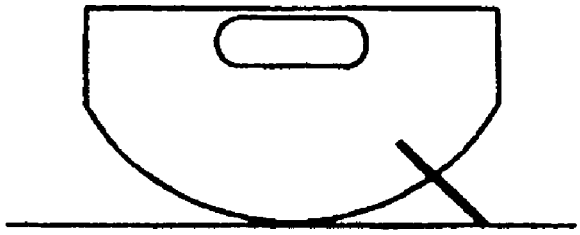
FIG. 11 is a side view of a shaking apparatus according to a fourth embodiment of the invention.
Figure 12:
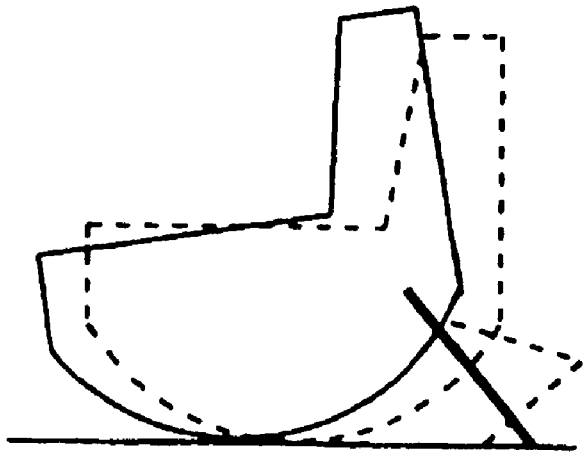
FIG. 12 is a side view of a shaking apparatus according to a fifth embodiment of the invention.
Figure 13:
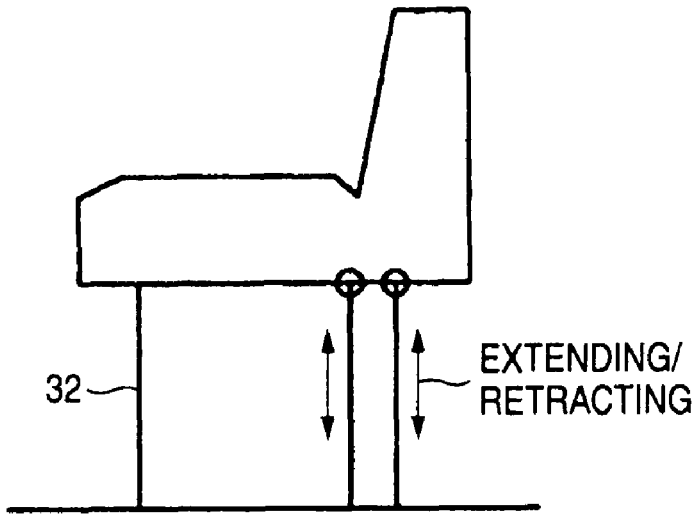
FIG. 13 is a side view of a shaking apparatus according to a sixth embodiment of the invention.
Figure 14:
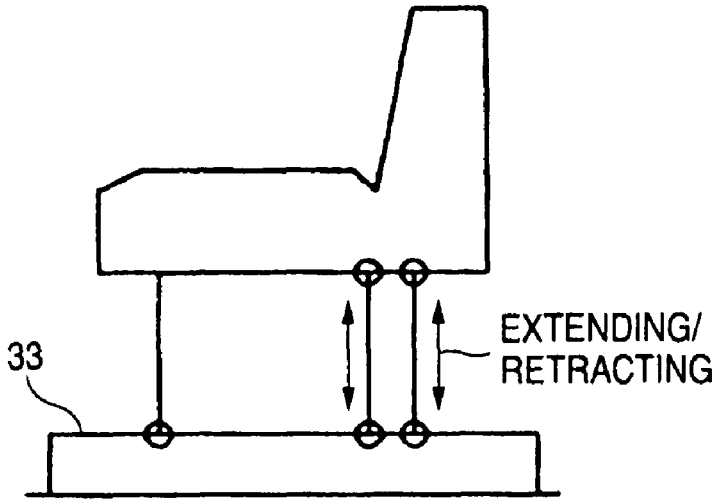
FIG. 14 is a side view of a shaking apparatus according to a seventh embodiment of the invention.

FIGS. 9 to 14 are side views of shaking apparatus according to second through seventh embodiments of the invention for comparing with the embodiment of FIGS. 1A, 1B, 1A1 and 1B1. The shaking apparatus according to the first embodiment is provided with only two legs, but an additional leg 31 may be provided as shown in FIG. 9. In the shaking apparatus according to the first embodiment of the invention, the whole floor side of the seat facing the floor is curved, but only a part of the bottom of the seat facing the floor may be curved as shown in FIG. 10. Further, as shown in FIG. 11, the back of the chair may be removed and the legs may be collapsed, as shown in FIG. 12, to incline the seat. Further, as shown in FIG. 13, the legs may be disposed vertically to the floor and the front supporting part may be a leg 32. Furthermore, as shown in FIG. 14, the legs may contact with the floor through a base 33 made of a plate-shaped material.

The seat is supported by three supporting parts at the front, rear left, and right sides in the above embodiments, but the invention is not limited thereto, while the seat may be supported by the three parts at the rear side, the front left and right sides.

In the above embodiments, although pictures seen from a vehicle are displayed for improved reality, the invention is not limited thereto and may have a variety of applications for improving reality by displaying a variety of picture contents, or displaying pictures of computer games. When the invention is applied for displaying pictures of computer games, as a user operates a joy stick, etc., the seat is shaken synchronously with the pictures.

The invention is applicable to an audiovisual system that provides reality to viewers, as if they exist in the scenes of pictures displayed in front of them, by shaking the seat synchronously with the pictures.

It should be understood by those skilled in the art that various modifications, combinations, sub-combinations and alterations may occur depending on design requirements and other factors insofar as they are within the scope of the appended claims or the equivalents thereof.

What is claimed is:

1. A shaking apparatus for shaking a user's seat comprising:

one or more actuators, and a seat that is supported by supporting parts at least at a front side, a rear left side and a right side, or a rear side, a front left side and a right side, wherein the seat is inclined left or right by complementarily operating one or more actuators mounted to the left and right supporting parts to extend or retract the supporting parts to complementarily vary the distance from a floor of the left and right supporting parts, wherein the seat is inclined forward or backward by equally operating the one or more actuators mounted to the left and right supporting parts to extend or retract the left and right supporting parts to equally vary the distance of the left and right supporting parts from the floor, and wherein each of the one or more actuators includes a screw mechanism being rotated to extend or retract in extension directions of the left and right supporting parts.

2. The shaking apparatus according to claim 1, wherein the left and right supporting parts are legs contacting with the floor.

3. The shaking apparatus according to claim 2, wherein a bottom of the seat facing the floor is curved, the front supporting part or the rear supporting part is a part on the curved bottom contacting with the floor.

4. The shaking apparatus according to claim 3, wherein the curved bottom is a hemisphere or a part of an ellipsoidal sphere.

5. The shaking apparatus according to claim 2, wherein the legs are extended or retracted by operating the one or more actuators to vary the distance of the left and right supporting parts from the floor.

6. The shaking apparatus according to claim 1 further comprising:

a vibrator vibrating the seat.

7. A method of shaking a user's seat comprising the steps of:

supporting the seat by supporting parts at least at a front side, a rear left side and a right side, or a rear side, a front left side and a right side, inclining the seat left or right by complementarily operating one or more actuators mounted to the left and right supporting parts to extend or retract the left and right supporting parts to complementarily vary the distance of the left and right supporting parts from a floor; and inclining the seat forward or backward by equally operating the one or more actuators mounted to the left and right supporting parts to extend or retract the left and right supporting parts to equally vary the distance of the left and right supporting parts from the floor, wherein each of the one or more actuators includes a screw mechanism being rotated to extend or retract in extension directions of the left and right supporting parts.

8. An audiovisual system comprising:

a shaking apparatus for shaking a user's seat, including one or more actuators, and a seat that is supported by supporting parts at least at a front side, a rear left side and a right side, or a rear side, a front left side and a right side, wherein the seat is inclined left or right by complementarily operating one or more actuators mounted to the left and right supporting parts to extend or retract the left and right supporting parts to complementarily vary the distance of the left and right supporting parts from a floor, wherein the seat is inclined forward or backward by equally operating the one or more actuators mounted to the left and right supporting parts to extend or retract the left and right supporting parts to equally vary the distance of the left and right supporting parts from the floor, and wherein each of the one or more actuators includes a screw mechanism being rotated to extend or retract in extension directions of the left and right supporting parts.

* * * * *